United States Patent [19]

Grogan et al.

[11] 3,986,644

[45] Oct. 19, 1976

[54] DISPENSING PUMP

[75] Inventors: Richard P. Grogan, Ontario; Rex C. Cooprider, Hacienda Heights; William S. Blake, Westminster, all of Calif.

[73] Assignee: Diamond International Corporation, City of Industry, Calif.

[22] Filed: May 21, 1975

[21] Appl. No.: 579,572

[52] U.S. Cl. ..... 222/207; 417/479

[51] Int. Cl.[2] ..... B65D 37/00

[58] Field of Search ..... 222/207, 206, 385; 417/437, 234, 235, 479, 383, 395, 380; 92/93

[56] References Cited

UNITED STATES PATENTS

| | | | |
|---|---|---|---|
| 2,980,032 | 4/1961 | Schneider | 417/479 |
| 3,061,202 | 10/1962 | Tyler | 222/380 X |
| 3,250,224 | 5/1966 | Phillips et al. | 417/479 |
| 3,379,381 | 4/1968 | Decaux | 222/385 X |
| 3,726,442 | 4/1973 | Davidson et al. | 222/207 |
| 3,749,290 | 7/1973 | Micallef | 222/385 |

FOREIGN PATENTS OR APPLICATIONS

| | | | |
|---|---|---|---|
| 1,184,447 | 12/1964 | Germany | 417/479 |

*Primary Examiner*—William L. Freeh
*Assistant Examiner*—Edward Look
*Attorney, Agent, or Firm*—Richard E. Babcock, Jr.

[57] ABSTRACT

A resiliently deformable diaphragm having a central domed portion surrounded by a marginal flange, has its flange clamped between opposing members of the pump housing whereby the central domed portion of the housing co-operates with one of the members to define a variable volume pump chamber. The convex side of the dome is received within a central opening in the other member and normally seats over and closes a vent port within said opening. An actuating lever fulcrumed on the housing has an arm movable upwardly through the said opening to deforming engagement with the diaphragm dome to alternately compress and to permit expansion of the dome. The inlet and outlet passages of the pump respectively extend from the pump chamber through the interfaces between the flange and the housing members and include inlet and outlet ports respectively controlled by the flange, recesses being provided in the interfaces at locations opposite the respective ports to permit deflection of portions of the flange so that they may function as inlet and outlet valves respectively.

8 Claims, 5 Drawing Figures

DISPENSING PUMP

This invention relates to an improved dispensing pump of the type in which a resiliently deformable diaphragm co-operates with a rigid housing member to define and herewith a variable volume pump chamber which is intermittently compressed and permitted to expand under its own resiliency. Such compression is normally achieved by manually operable actuating means, such as a trigger or a lever, arranged to deform the diaphragm by compressing it against its associated housing member, the resilient restoring action of the diaphragm being generally relied upon in place of a return spring for returning the lever or trigger to its starting position.

In prior pumps of the above mentioned type, it has been known to form the inlet and outlet valve portions as relatively separate skirts, flaps or appendages of the diaphragm, as in the U.S. Pat. No. 3,752,366 to Lawrence.

In accordance with the present invention however the diaphragm is so formed that, when associated with the other parts of the pump, a flange which encircles and is a unitary portion of the diaphragm serves both as the inlet and outlet valves and as the means for mounting the diaphragm in the pump housing, and also as a gasket providing a leakproof seal between the housing members. Further in accordance with the invention a portion of the same diaphragm co-operates with a vent passage, to close that passage at all times except when the diaphragm is deformed during the course of the pumping operation.

In a preferred embodiment of the invention, the co-operating parts are so interrelated and conformed as to eliminate any necessity for angular or rotational orientation of the diaphragm with respect to the other parts during assembly of the pump.

It follows from the foregoing that a pump in accordance with the invention involves a minimum of parts and assembling operations and thus is capable of extremely economic production.

Moreover in accordance with a further aspect of the invention, the pump housing is supported in cantilever fashion at one side of the container for the product to be dispensed by the pump, the arrangement being such that the housing has a downwardly directed opening through which an arm of the actuating trigger or lever is movable upwardly into and from deforming engagement with the diaphragm. By this arrangement the diaphragm is protected against accidental deformation by stacking of containers to which the pump is applied, while at the same time permitting an extremely simple and a direct application of the trigger, lever or other operating mechanism for the pump.

To generally summarize the invention, the same comprises upper and lower housing members interconnected in fluid tight manner to define a pump housing in which the interconnected members have relatively opposed upper and lower clamping surfaces of endless configuration. The resiliently deformable pump diaphragm has an encircling flange, also of endless configuration, which is clamped between the clamping surfaces in normally fluid tight manner, with the diaphragm and the upper housing member jointly defining an enclosed pump chamber. The lower housing member has a central opening therethrough surrounded by its clamping surface, and the operating lever or other actuating means is carried by the housing for movement through the opening for selectively deforming the latter. Depending from the lower housing member across its opening from the actuating means, is a plug by means of which the pump is adapted to be supported on the container of fluid to be dispensed and through which the pump is placed in communication with the interior of the container. To this end the lower housing member of the pump is formed with an inlet port communicating with the container through the above mentioned plug and opening upwardly through the lower clamping surface of the lower housing member at a location beneath the diaphragm flange. The upper clamping surface of the upper housing member in turn is formed with a recess opposite the inlet port to permit local upward flexing of the flange so that fluid may be sucked through the inlet port into the pump chamber on the expansion stroke of the diaphragm. The upper housing member is formed with an outlet port communicating with the pump chamber and opening downwardly through its clamping surface, the arrangement being such that the diaphragm flange normally seats against this last mentioned surface to close the outlet port. Opposite the outlet port, the lower housing member is formed with a recess for permitting local downward flexing of an outer portion of the flange so that fluid may flow from the pump chamber into the recess when the diaphragm is deformed on its compression stroke. The recess in turn communicates through a discharge passage with the atmosphere.

The presently preferred embodiment of the invention is illustrated in the accompanying drawing in which.

Figure 2:
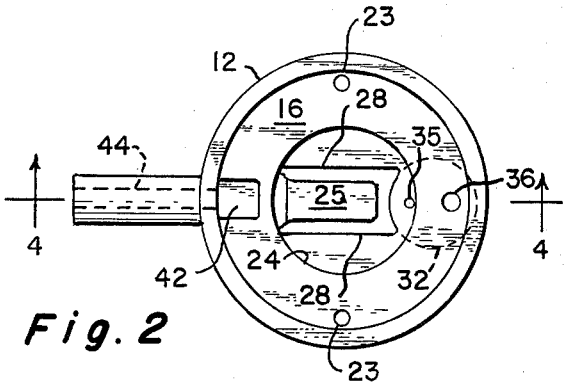
FIG. 2 is a detail plan view of the lower housing member of the pump housing, the upper housing member and diaphragm being removed.
Figure 3:
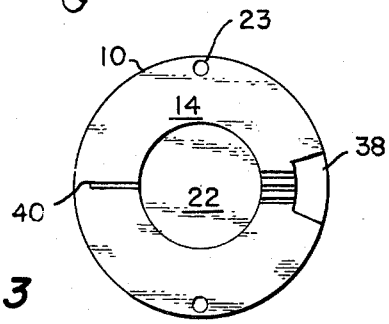
FIG. 3 is a detail bottom plan view of the upper housing member.

Referring now in detail to the accompanying drawings:

The pump of the preferred embodiment comprises a rigid pump housing which is defined by the upper and lower rigid housing members 10 and 12 respectively having relatively opposed upper and lower clamping surfaces 14 and 16 (best shown in FIGS. 3 and 2 respectively) of endless, preferably circular configuration, between which is clamped the encircling flange 18 of a resiliently deformable diaphragm 20 which co-operates with the upper housing member 10 to therewith define an enclosed pump chamber 22. The housing members may be interconnected by conventional means, such as threaded fasteners, disposed through the holes 23. The diaphragm 20 includes, as an integral portion thereof, a central dome of generally hemispherical shape within the encircling preferably circular flange 18, with the concave side of the dome presented toward the housing member to therewith define the pump chamber 22 and the upwardly presented base or periphery of the dome, at its juncture with the flange, preferably abutting against the under face of the upper housing member 10, to be compressed and deformed thereagainst during the pumping operation.

The convex side of the dome is received in the central opening 24 of the lower housing member for engagement by the lever arm 25 of an actuating lever or trigger 26, the upper end of which is fulcrumed at 27 to the lower housing member for swinging movement in a slot 28 (FIG. 2) which communicates with the opening 24. It is to be noted that in the illustrated embodiment, the inner edge portion of the flange 18 is in permanent sealing engagement with the lower clamping surface 14 completely around the opening 24 to thereby prevent leakage into the opening of the fluid product being pumped.

While provision of the hereinafter described intake and discharge passages and ports will permit passage of fluid outwardly from the pump chamber 22 above the flange 18, as an incident to the pumping operation, the two housing members 10 and 12 are interconnected in fluid tight manner, as for instance by the provision of a ring type seal 30 to prevent undesired leakage of the liquid product from the housing and to confine same to its intended path of discharge.

Depending from the lower housing member 12 at a location across the central opening 24 thereof from the trigger or actuating lever 26 is a supporting plug 32 preferably constituting an integral portion of the lower housing member 12.

The plug 32 extends through an opening in a closure cap 33 which is threaded onto the container neck, and is formed with an integral encircling flange 31 which is claimed between the cap and the upper end of the container neck. The plug thus supports the pump housing 10, 12 and actuating lever 26 in cantilever manner from the container, with both the operating lever or trigger 26 and the diaphragm 20 offset laterally from the container at one side thereof, all in a manner to minimize the total height of the container and pump, while placing the depending lever 26 in an optimum position for actuation by the same hand of the user which encircles and grips the upper portion of the container during the pumping operation.

It will be noted that the plug 32 projects into the opening 24 and its upper end portion is formed to define a sealing surface 34 which is shaped and disposed for sealing engagement with the exterior convex surface of the diaphragm dome 20 when the latter is in its normally fully expanded and undeformed condition. A vent passage 35 extends upwardly from the container interior through the lower end of the plug 32 and terminates in a vent port opening to the atmosphere through the venting valve seat defined by the surface 34.

Also extending upwardly from the interior of the container through the plug 32 is an inlet passage 36 which opens upwardly through the lower clamping surface 16 to define an inlet port at a location normally covered and closed by the flange 18 which seats against the lower clamping surface around the port thus provided. By means of a conventional dip tube 37, the inlet passage communicates with the lower end portion of the container.

The upper clamping surface 14 of the upper housing member is formed with a recess 38 directly opposite the inlet port 36 to permit local upward flexing and unseating of the outer edge portion of the flange 18. Since the recess 38 communicates with the pump chamber across the upper surface of the flange 18, suction produced by expansion of the pump chamber on its suction stroke, will open or unseat the flange 18 from inlet port 36 and draw liquid product from the container into the pump chamber.

Also formed in the upper housing member is an outlet port defined by one or more slots 40 extending outwardly partially across the downwardly presented clamping surface 14 and opening downwardly to the flange 18. The flange 18 in its undeformed state normally seats against the clamping surface 14 and over the downwardly opening outlet port 40 to close the latter.

Directly beneath the outlet port 40, the lower housing member is formed with a recess 42 which extends beneath the outer peripheral edge of the flange and is proportioned to permit local downward flexing of the outer edge portion of the flange so that the latter may unseat from and open the outlet port 40 to permit a flow of the fluid product from the pump chamber 22 into the recess 42 which in turn communicates with a discharge spout 44 leading to the atmosphere.

Figure 1:
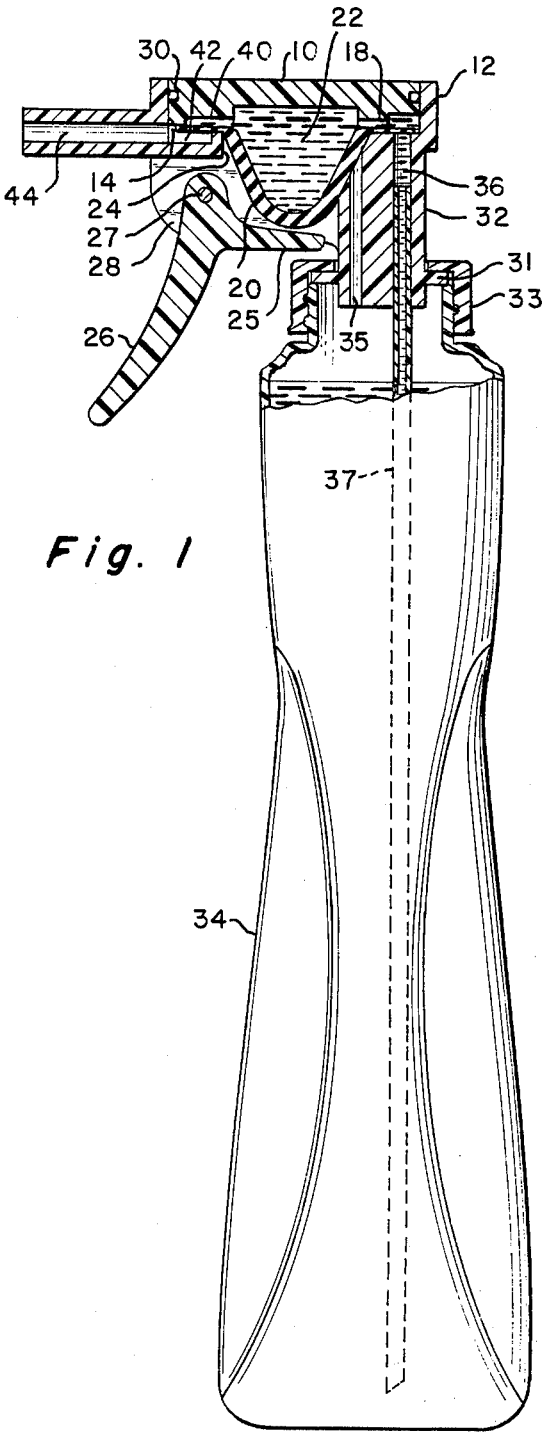
FIG. 1 is a cross sectional view through a pump of the invention as applied to a conventional product container for dispensing the liquid or fluid product therefrom.
Figure 4:
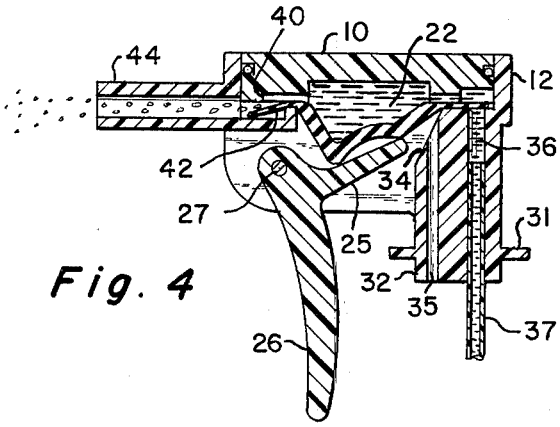
FIGS. 4 and 5 are similar sectional views, taken on the line 4—4 of FIG. 1, of the operative portions of the pump structure, showing the positions assumed by the parts respectively during the compression or discharge stroke of the pump, and during its suction or return stroke.

In the operation of the invention, with the pump applied to a container in the manner illustrated and described in connection with FIG. 1, the container may be supported in one hand with the fingers of that hand encircling the depending trigger 26 so as to be capable of intermittently squeezing and releasing the trigger. This will alternately collapse the pump chamber 22 as shown in FIG. 4 and permit it to expand under its own resiliency. The resilient expansion of the chamber which occurs whenever the trigger is released serves to return the trigger to its normal position of FIG. 1.

Figure 5:
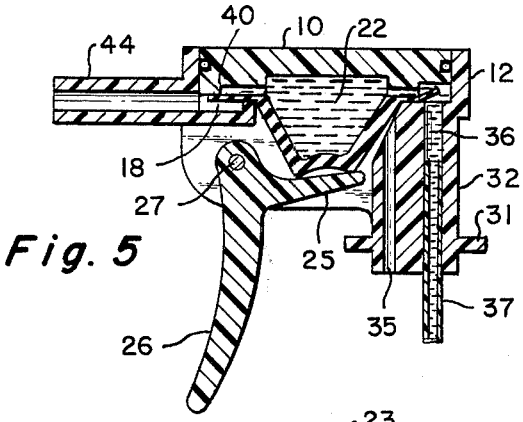

Assuming that the pump has been primed to fill the pump chamber with the liquid to be dispensed, each time the trigger is actuated to collapse the resilient diaphragm dome 20, the resulting pressure of fluid on flange 18 unseats it from the port 40 so as to allow a portion of the pump chamber contents to be discharged through the port and discharge passage 42, 44 into the atmosphere. Upon release of the trigger, the resulting resilient expansion of the dome returns the trigger to its original position, while opening the flange 18 from inlet port 36, due to the resulting sub-atmospheric pressure and drawing a fresh supply of fluid from the container into the pump chamber, as best illustrated in FIG. 5.

It will be readily appreciated that during each compression stroke, the deformation of the dome 20 by the trigger, as shown in the drawing, will cause the dome to uncover the upper end of the vent passage 35 whereby atmospheric air may flow into the opening and through said passage into the container to replace that portion of the liquid product which is withdrawn from the container by the pumping action and, in general, to maintain the interior of the container at substantial atmospheric pressure.

It will thus be seen that the single integral diaphragm structure herein disclosed is so formed that when associated with the other parts of the pump, separate portions of the diaphragm serve the multiple functions of intake and discharge valves, as well as of a venting valve and, in addition, the inner periphery of the flange serves as a seal to prevent loss or leakage of liquid product through the central opening 22 of the lower housing member through which the lever arm 25 moves in operative engagement with the resiliently deformable dome.

Further, it will be apparent where the dome and its flange are of circular configuration, they may be readily operatively assembled to the associated housing members without necessity for angular or rotational orientation with respect to those members, it being necessary only that the members themselves be oriented with respect to each other. Such orientation may be readily accomplished by use of suitably located fasteners or other means well known in the art.

Having thus described our invention, we claim:

1. A pump of the resiliently deformable diaphragm type comprising:

upper and lower housing members interconnected in fluid tight manner to define a pump housing, said members respectively having relatively opposed upper and lower clamping surfaces;

a resiliently deformable diaphragm having an encircling imperforate flange clamped between said clamping surfaces in normally fluid tight manner, said flange constituting a unitary portion of said diaphragm and defining the sole area of engagement between said diaphragm and said housing members;

said diaphragm and said upper housing member jointly defining an enclosed pump chamber;

said lower housing member having a central opening therethrough surrounded by its said clamping surface;

actuating means carried by said housing for movement through said opening in operative engagement with said diaphragm for deforming the latter to vary the volume of said pump chamber;

said lower housing member being formed with an inlet port adapted for communication with a source of fluid and opening upwardly through said lower clamping surface beneath said flange, said upper clamping surface being formed with a recess opposite said inlet port extending from the outer peripheral edge of said flange into communication with said pump chamber to permit local upward flexing of said flange and flow of fluid from said inlet port around the outer edge of said flange into said recess;

said upper housing member being formed with an outlet port communicating with said pump chamber and opening downwardly through said upper clamping surface, said flange normally seating against said last mentioned clamping surface to close the outlet port;

said lower housing member being formed with a further recess in said lower clamping surface opposite said outlet port extending to the outer peripheral edge of said flange for permitting local downward flexing of said outer peripheral edge and flow of fluid from said pump chamber around said outer peripheral edge into said further recess, said further recess communicating through a discharge passage with the atmosphere.

2. A pump as defined in claim 1, in which said actuating means comprises a lever fulcrumed on and depending from the pump housing at one side of said central opening, and having a lever arm disposed for operative movement upwardly through said opening into deforming engagement with said resiliently deformable diaphragm, and for return movement responsive to resilient return of the diaphragm to its normal undeformed shape.

3. A pump as defined in claim 2 wherein said lower housing member is formed with a vent passage communicating with the interior of a container to which the pump is applied, said vent passage terminating in a vent port within said central opening, said port being surrounded by a valve seat positioned for sealing engagement with the diaphragm in the normally undeformed condition thereof, and for disengagement with the diaphragm to open said port when the diaphragm is deformed by said lever arm.

4. A pump as defined in claim 2, in which said diaphragm includes a central dome within said encircling flange, the concave side of said dome being presented toward said upper housing member to therewith define the pump chamber, the convex side of said dome being received in said central opening for engagement by said lever arm.

5. A pump as defined in claim 2, including a supporting plug depending from said housing for fluid tight reception in the outlet of a container, means for securing said plug in fluid tight manner in a container outlet, said plug being located across said opening from the said lever to support said pump housing and lever in cantilever manner from the container, with the lever spaced laterally from the container at one side thereof, there being an inlet passage extending through the lower end of said plug and terminating in said inlet port, and a dip tube establishing communication between said passage and the lower portion of the container.

6. A pump as defined in claim 5 wherein said housing is formed with a vent passage establishing with the interior of a container to which the pump is applied, said vent passage extending upwardly through the lower end of said plug and terminating in a vent port within said central opening, said housing defining a valve seat around said vent port for sealing engagement with the diaphragm in the normally undeformed condition of the diaphragm.

7. A pump as defined in claim 1, in which said diaphragm flange and said clamping surfaces of the housing members are of annular configuration to avoid necessity for angular orientation of the diaphragm with respect to said housing members.

8. A pump as defined in claim 7, in which said diaphragm includes a central dome within said encircling flange, the concave side of said dome being presented toward said upper housing member to therewith define the pump chamber, the convex side of said dome being received in said central opening, said central opening communicating with the atmosphere, said lower housing member being formed with a vent passage terminating in a vent port within said opening, said port being surrounded by a valve port conformed for sealing engagement with the convex side of said dome in the normally undeformed condition of said dome.

* * * * *